US009257793B2

(12) United States Patent
Lo et al.

(10) Patent No.: US 9,257,793 B2
(45) Date of Patent: Feb. 9, 2016

(54) HIGH FREQUENCY ELECTRICAL CONNECTOR

(71) Applicant: Lintes Technology Co., Ltd, New Taipei (TW)

(72) Inventors: Wei Zen Lo, New Taipei (TW); Shih Chi Kuan, New Taipei (TW); Cheng Han Yang, New Taipei (TW)

(73) Assignee: LINTES TECHNOLOGY CO., LTD, New Taipei (TW)

( * ) Notice: Subject to any disclaimer, the term of this patent is extended or adjusted under 35 U.S.C. 154(b) by 0 days.

(21) Appl. No.: 14/276,781

(22) Filed: May 13, 2014

(65) Prior Publication Data

US 2014/0364006 A1 Dec. 11, 2014

Related U.S. Application Data

(60) Provisional application No. 61/831,890, filed on Jun. 6, 2013.

(51) Int. Cl.

| | |
|---|---|
| ***H01R 13/6461*** | (2011.01) |
| ***H01R 13/6471*** | (2011.01) |
| *H01R 12/71* | (2011.01) |
| *H01R 12/50* | (2011.01) |
| *H01R 13/658* | (2011.01) |
| *H01R 13/6594* | (2011.01) |
| *H01R 13/6581* | (2011.01) |
| *H01R 12/72* | (2011.01) |

(52) U.S. Cl.

CPC ..... *H01R 13/6461* (2013.01); *H01R 13/6471* (2013.01); *H01R 12/712* (2013.01); *H01R 12/716* (2013.01); *H01R 12/724* (2013.01); *H01R 13/6581* (2013.01); *H01R 13/6594* (2013.01); *H01R 13/65807* (2013.01); *H01R 23/688* (2013.01); *H01R 23/6873* (2013.01)

(58) Field of Classification Search

CPC ..... H01R 23/6873; H01R 13/6594; H01R 12/716; H01R 12/724; H01R 12/712; H01R 13/6581; H01R 13/6461; H01R 13/6471; H01R 23/688; H01R 13/65807

USPC ..... 439/607.08, 607.05, 607.35, 607.4

See application file for complete search history.

(56) References Cited

U.S. PATENT DOCUMENTS

| | | | | |
|---|---|---|---|---|
| 7,758,379 | B2 * | 7/2010 | Chen | H01R 13/6485 439/607.11 |
| 2006/0141866 | A1 * | 6/2006 | Shiu | 439/608 |

* cited by examiner

*Primary Examiner* — Abdullah Riyami
*Assistant Examiner* — Justin Kratt
(74) *Attorney, Agent, or Firm* — Locke Lord LLP; Tim Tingkang Xia, Esq.

(57) ABSTRACT

An electrical connector includes a body, two rows of terminals, and a grounding sheet. The body has a base and a tongue extending forwards from the base. The two rows of terminals are disposed in the tongue. At least one row of terminals includes a differential signal terminal pair and a grounding terminal that are disposed neighboring to each other. The grounding sheet is disposed in the tongue and located between the two rows of terminals. The grounding sheet has an open slot located between the differential signal terminal pair and the grounding terminal that are in the same row.

16 Claims, 7 Drawing Sheets

HIGH FREQUENCY ELECTRICAL CONNECTOR

CROSS-REFERENCE TO RELATED APPLICATION

This application claims priority and the benefit of U.S. Provisional Application No. 61/831,890, filed on Jun. 6, 2013, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to an electrical connector having good high-frequency characteristics.

BACKGROUND OF THE INVENTION

Chinese Patent No. CN200920302446.4 discloses an electrical connector, which includes an insulating body. A front end of the insulating body is provided with a tongue. An upper side and a lower side of the tongue are respectively provided with a first conductive terminal and a second conductive terminal. The tongue has a narrow slot. The narrow slot runs through the tongue in a front-to-rear direction. A grounding sheet is received in the narrow slot. A rear end of the grounding sheet is integrally provided with a pin. The pin is connected to a grounding line of the circuit board. The grounding sheet can effectively prevent electromagnetic interference between the first conductive terminal and the second conductive terminal.

For low frequency cases, the above-mentioned method of disposing a grounding sheet can prevent electromagnetic interference. However, as the frequencies of signals transmitted in the electronic industry are becoming higher, electromagnetic interference between terminals seriously affects the transmission effect of high frequency signals, and the grounding sheet cannot meet the demand of preventing electromagnetic interference between terminals.

Therefore, a heretofore unaddressed need exists in the art to address the aforementioned deficiencies and inadequacies.

SUMMARY OF THE INVENTION

In one aspect, the present invention is directed to an electrical connector for reducing cross talk between terminals to improve high frequency characteristics.

In one embodiment, the electrical connector includes a body, two rows of terminals, and a grounding sheet. The body has a base and a tongue extending forwards from the base. The two rows of terminals are disposed in the tongue. At least one row of terminals includes a differential signal terminal pair and a grounding terminal that are disposed neighboring to each other. The grounding sheet is disposed in the tongue and located between the two rows of terminals. The grounding sheet has an open slot. The open slot is located between the differential signal terminal pair and the grounding terminal that are in the same row.

In one embodiment, the two rows of terminals are central-symmetrically arranged.

In one embodiment, the differential signal terminal pair includes a pair of differential signal terminals, and the grounding terminal has a width greater than that of the signal terminal.

In one embodiment, the width of the grounding terminal is 2 times that of the signal terminal.

In one embodiment, the differential signal terminal pair includes a pair of differential signal terminals, and a distance between the grounding terminal and the neighboring differential signal terminal is greater than a distance between the pair of differential signal terminals.

In one embodiment, the distance between the grounding terminal and the neighboring differential signal terminal is 1.5 times the distance between the pair of differential signal terminals.

In one embodiment, each terminal has a fixing portion fixed in the base, a contact portion extending forwards from the fixing portion and exposed to the tongue, and a soldering portion bent and extending backwards and downwards from the fixing portion.

In one embodiment, a top surface and a bottom surface of the tongue are each provided with a plurality of grooves, and the contact portion is exposed in the groove.

In one embodiment, the contact portion is in a flat plate shape.

In one embodiment, the contact portion has a plurality of bent portions to form a multipoint contact.

In one embodiment, the open slot is formed in a front-to-rear direction with a length greater than that of the contact portion.

In one embodiment, the grounding sheet extends backwards from a front end of the tongue to a rear end of the base, and the open slot is formed in a front-to-rear direction.

In one embodiment, the open slot extends by a length substantially equal to the length of the grounding sheet.

As compared with the related art, certain embodiments of the present invention, among other things, have the following beneficial advantages.

The grounding sheet is located between the two rows of terminals, the grounding sheet is provided with at least one open slot, and the open slot is located between the differential signal terminal pair and the grounding terminal that are in a same row, so that cross talk between the two rows of terminals can be effectively prevented during transmission of high frequency signals, thereby improving high frequency characteristics.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
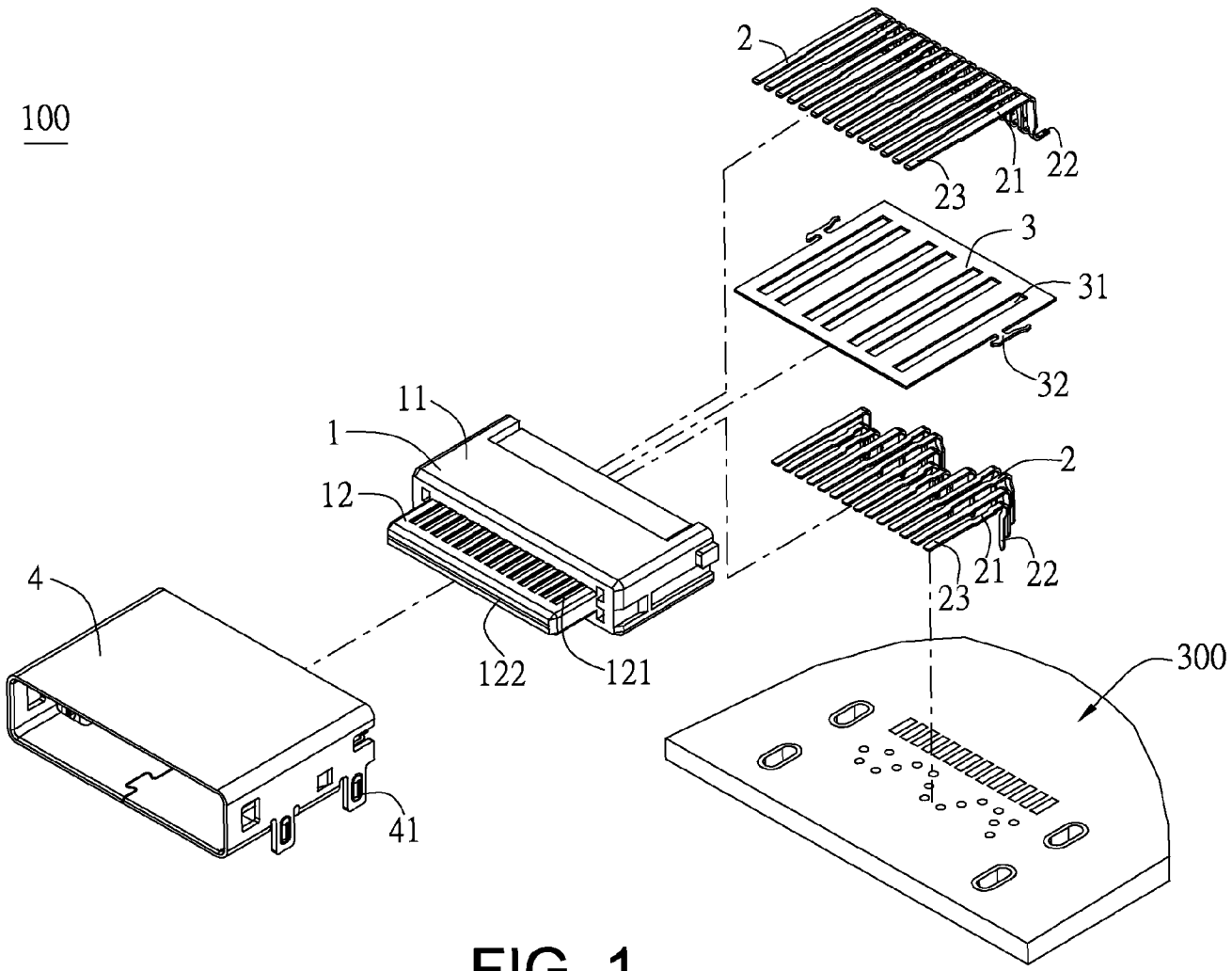
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to an electrical connector.

Figure 2:
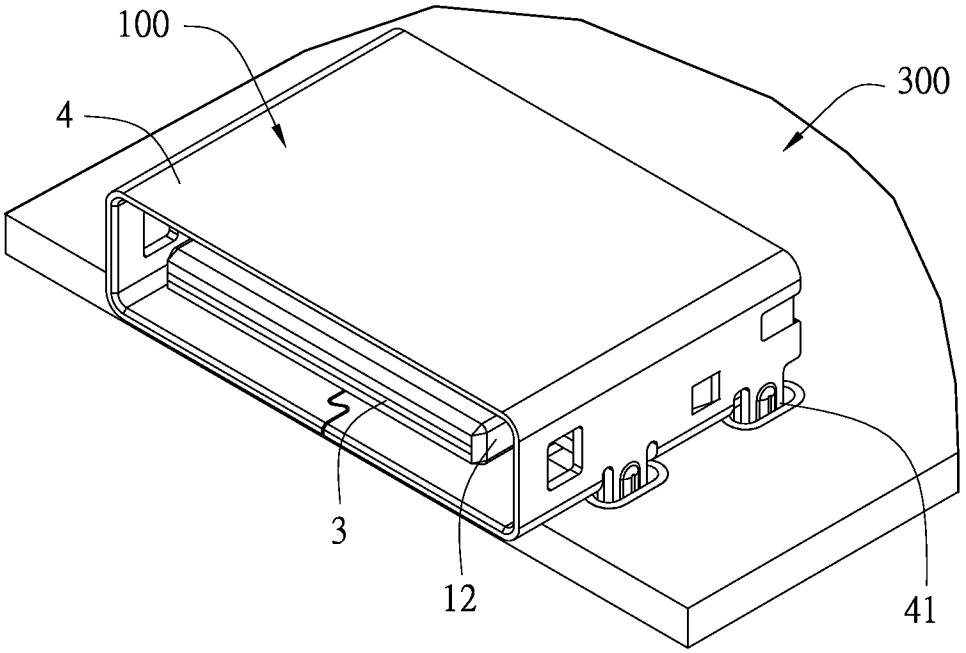
FIG. 2 is a schematic three-dimensional assembled view of the electrical connector according to one embodiment of the present invention.

As shown in FIG. 1 and FIG. 2, an electrical connector 100 according to one embodiment of the present invention includes a body 1, two rows of terminals 2 disposed in the body 1, a grounding sheet 3 disposed between the two rows of terminals 2, and a metal housing 4 sleeved over the body 1.

As shown in FIG. 1, the body 1 includes a base 11 and a tongue 12 extending forwards from the base 11. A top surface and a bottom surface of the tongue 12 are each provided with a plurality of grooves 121 for accommodating the terminals 2. Each of the grooves 121 runs through a rear end surface of the base 11. The tongue 12 is formed with a narrow slot 122 from a front surface thereof to accommodate the grounding sheet 3.

Figure 4:
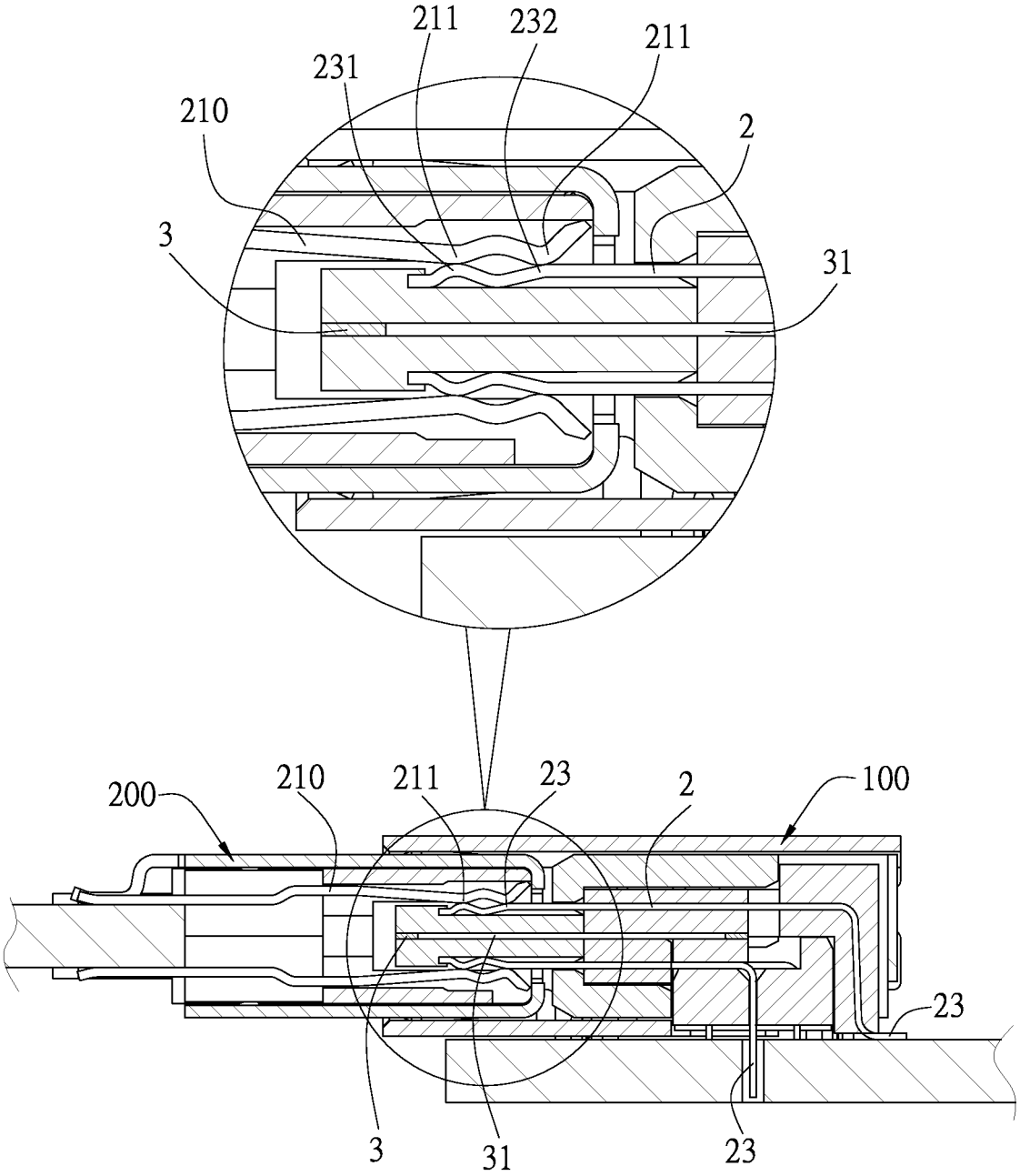
FIG. 4 is a schematic sectional view of a second embodiment of the present invention when terminals are in contact with each other.

As shown in FIG. 1, the terminals 2 are divided into an upper row and a lower row, and are all located in the tongue 12. Each of the terminals 2 has a fixing portion 21 fixed to the base 11, a soldering portion 22 bent and extending backwards and downwards from the fixing portion 21, and a contact portion 23 extending forwards from the fixing portion 21 and exposed in the groove 121. In this embodiment, the soldering portions 22 of the upper row are soldered onto a surface of a circuit board 300, and the soldering portions 22 of the lower row are soldered into holes in the circuit board 300. In this embodiment, the contact portion 23 is in a flat plate shape. As shown in FIG. 4, in a second embodiment, the contact portion 23 has a plurality of bent portions to form a multipoint contact. The contact portion 23 includes a first bent portion 231 located at a front end of the terminal 2, and a second bent portion 232 located between the first bent portion 231 and the fixing portion 21. The first bent portion 231 is adjacent to a front end portion of the terminal 2. The electrical connector 100 is used for being mated to a mating connector 200. The mating connector 200 is provided therein with a plurality of contact members 210. Each of the contact members 210 also has a plurality of contact points 211 for contact with the contact portions 23. Through the multipoint contact, a close contact between the terminal 2 and the contact member 210 is ensured, thereby ensuring electrical connection between the electrical connector 100 and the mating connector 200.

Figure 3:
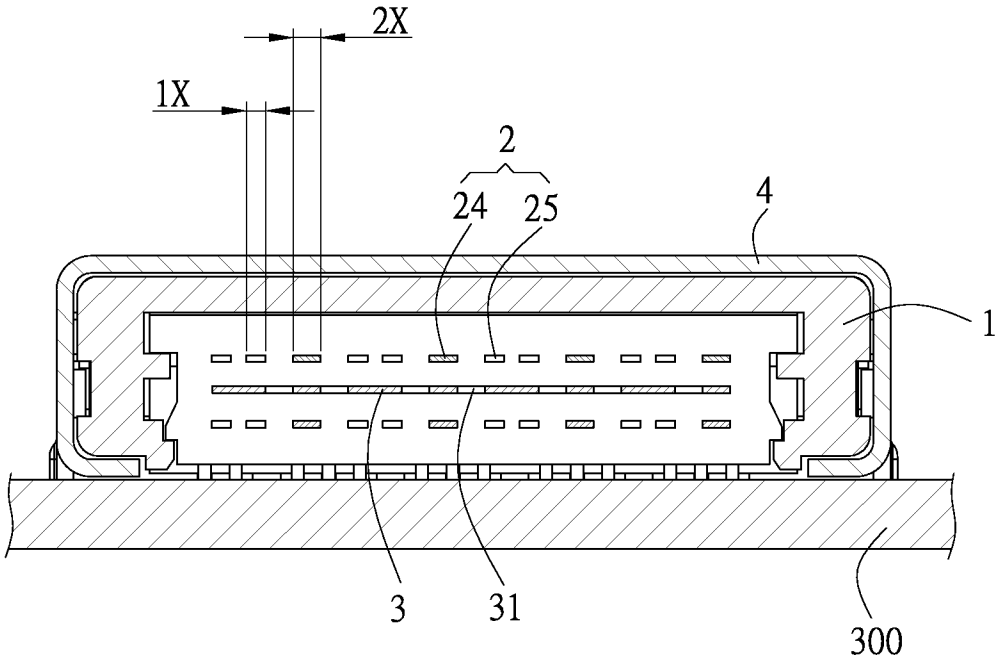
FIG. 3 is a schematic sectional view of the electrical connector according to one embodiment of the present invention.
Figure 5:
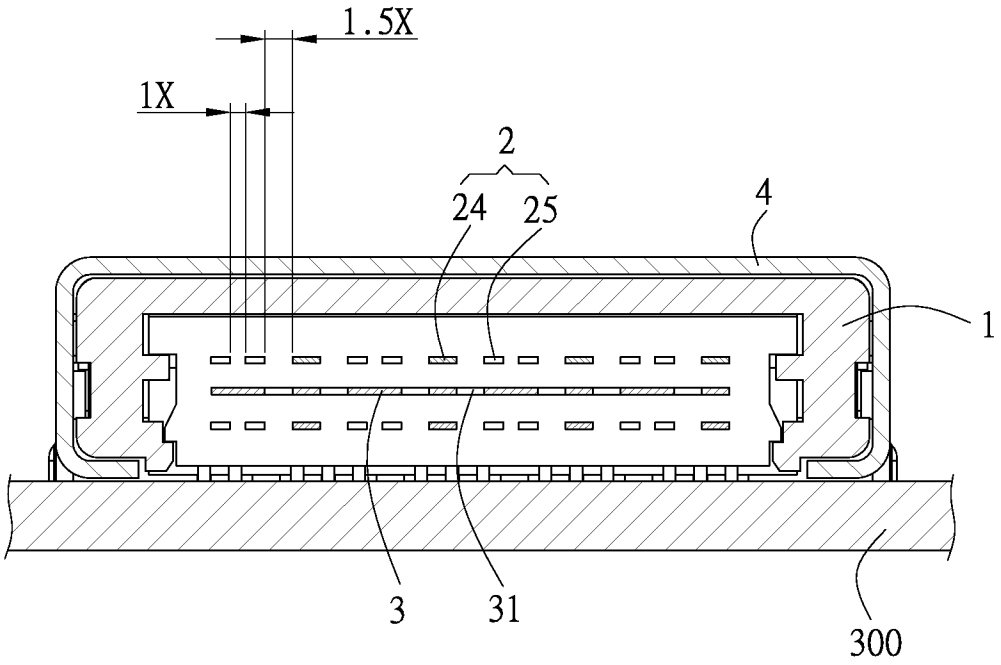
FIG. 5 is a schematic sectional view of a third embodiment of the present invention.

As shown in FIG. 1 and FIG. 3, each row of terminals 2 includes grounding terminals 24 and differential signal terminal pairs arranged in sequence, and each of the differential signal terminal pairs includes a pair of differential signal terminals 25. In this embodiment, the grounding terminal 24 has a width greater than that of the differential signal terminal 25, and particularly, the contact portion 23 of the grounding terminal 24 has a width greater than that of the contact portion 23 of the differential signal terminal 25. In one embodiment, the width of the grounding terminal 24 is 2 times the width of the differential signal terminal 25. As shown in FIG. 5, in a third embodiment, a distance between the grounding terminal 24 and the neighboring differential signal terminal 25 is greater than a distance between the pair of differential signal terminals 25. In one embodiment, the distance between the grounding terminal 24 and the neighboring differential signal terminal 25 is 1.5 times the distance between the pair of differential signal terminals 25. High frequency characteristics can be improved by increasing the width of the grounding terminal 24, reducing the width of the differential signal terminal 25, and/or changing the distance between the differential signal terminal 25 and the grounding terminal 24.

Figure 6:
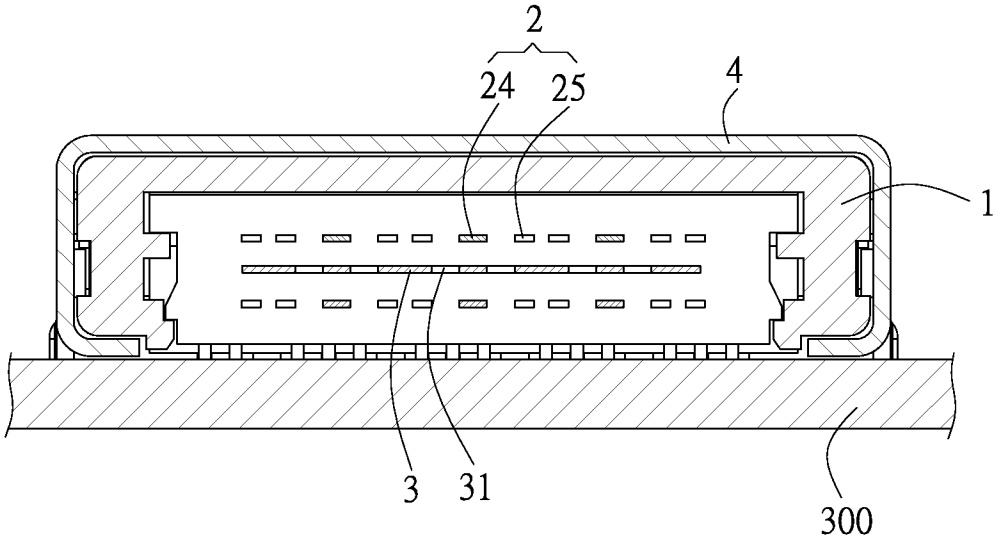
FIG. 6 is a schematic sectional view of a fourth embodiment of the present invention.

As shown in FIG. 6, in a fourth embodiment, the upper row of terminals 2 and the lower row of terminals 2 are central-symmetrically arranged, so that the mating connector 200 can be inserted into the electrical connector 100 in either a forward or backward manner, which improves the adaptability of the electrical connector 100.

Figure 7:
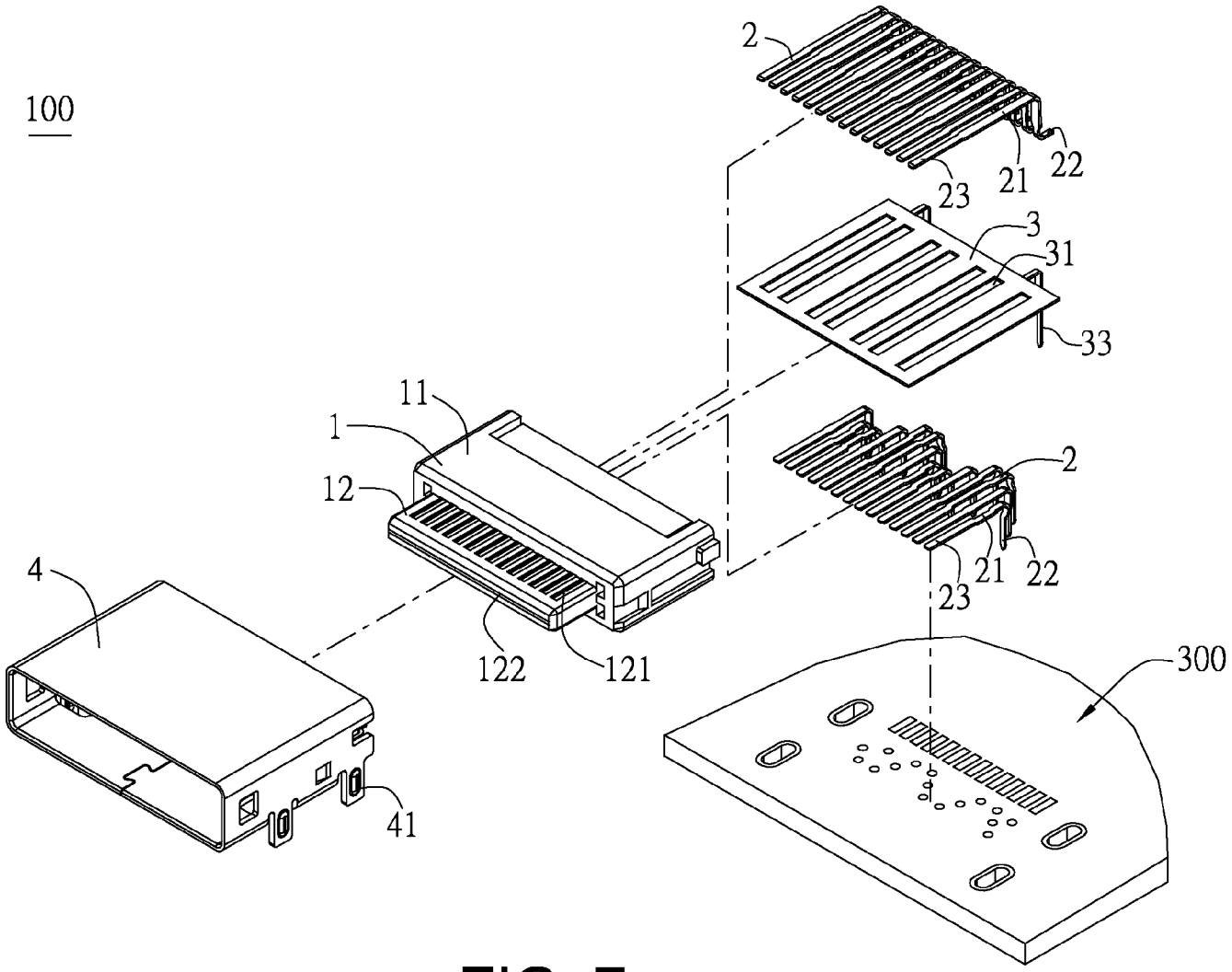
FIG. 7 is a schematic three-dimensional exploded view of an electrical connector according to one embodiment of the present invention.

As shown in FIG. 1 and FIG. 3, the grounding sheet 3 is disposed in the narrow slot 122, and located between the upper row of terminals 2 and the lower row of terminals 2. The grounding sheet 3 is provided with a plurality of open slots 31, the open slots 31 run through the grounding sheet 3 from top to bottom, and the open slots 31 are formed in a front-to-rear direction with a length greater than that of the contact portion 23. In this embodiment, the length of the open slot 31 formed in the front-to-rear direction is substantially equal to the length of the grounding sheet 3. The open slot 31 is located between the differential signal terminal pair and the grounding terminal 24 that are in a same row, that is, the open slot 31 is located between the differential signal terminal 25 and the grounding terminal 24 that are neighboring to each other in a same row, so that the differential signal terminals 25 of the upper and lower rows are not exposed in the open slots 31. In this way, cross talk between the two rows of terminals 2 can be effectively prevented during transmission of high frequency signals, thereby improving high frequency characteristics. The grounding sheet 3 is provided with a grounding pin 32 for contact with the metal housing 4 as shown in FIG. 1, or is provided with a grounding pin 33 directly soldered onto the circuit board 300, as shown in FIG. 7.

The metal housing 4 is sleeved over the body 1, and a bottom portion thereof is provided with a soldering leg 41 for being soldered to the circuit board 300.

The electrical connector 100 can be used for transmitting both low frequency and high frequency signals. When the electrical connector 100 transmits a high frequency signal, the open slots 31 formed in the grounding sheet 3 ensure that a smooth curve of high frequency characteristics can be obtained and the signal can be stably transmitted, thereby preventing cross talk between the terminals.

Based on the above, the electrical connector 100 according certain embodiment of the present invention has the following beneficial advantages.

(1) The grounding sheet 3 is provided with the open slots 31, and the open slot 31 is located between the differential signal terminal 25 and the grounding terminal 24 that are neighboring to each other in a same row, so that a smooth curve of high frequency characteristics can be obtained and the signal can be stably transmitted, thereby preventing cross talk between the terminals 2.

(2) Each of the contact members 210 also has a plurality of contact points 211 for contact with the contact portion 23. Through the multipoint contact, a close contact between the terminal 2 and the contact member 210 is ensured, thereby ensuring electrical connection between the electrical connector 100 and the mating connector 200.

(3) The grounding terminal 24 has a width greater than that of the differential signal terminal 25, and/or the distance between the grounding terminal 24 and the neighboring differential signal terminal 25 is greater than the distance between the pair of differential signal terminals 25. High frequency characteristics can be improved by increasing the width of the grounding terminal 24, reducing the width of the differential signal terminal 25, and/or changing the pitch between the differential signal terminal 25 and the grounding terminal 24.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a body, having a base and a tongue extending forwards from the base;

two rows of terminals disposed in the tongue, wherein at least one row of terminals comprises a differential signal terminal pair and a grounding terminal that are disposed neighboring to each other; and a grounding sheet disposed in the tongue and located between the two rows of terminals, and comprising at least one grounding pin for grounding, wherein the grounding sheet is provided with an open slot, and the open slot is located between the differential signal terminal pair and the grounding terminal that are in the same row.

2. The electrical connector according to claim 1, wherein the two rows of terminals are central-symmetrically arranged.

3. The electrical connector according to claim 1, wherein the differential signal terminal pair comprises a pair of differential signal terminals, and the grounding terminal has a width greater than that of the signal terminals.

4. The electrical connector according to claim 3, wherein the width of the grounding terminal is 2 times that of the signal terminals.

5. The electrical connector according to claim 1, wherein the differential signal terminal pair comprises a pair of differential signal terminals, and a distance between the grounding terminal and the neighboring differential signal terminal is greater than a distance between the pair of differential signal terminals.

6. The electrical connector according to claim 5, wherein the distance between the grounding terminal and the neighboring differential signal terminal is 1.5 times the distance between the pair of differential signal terminals.

7. The electrical connector according to claim 1, wherein the terminal has a fixing portion fixed in the base, a contact portion extending forwards from the fixing portion and exposed to the tongue, and a soldering portion bent and extending backwards and downwards from the fixing portion.

8. The electrical connector according to claim 7, wherein a top surface and a bottom surface of the tongue are each provided with a plurality of grooves, and the contact portion is exposed in the groove.

9. The electrical connector according to claim 7, wherein the contact portion is in a flat plate shape.

10. The electrical connector according to claim 7, wherein the contact portion has a plurality of bent portions to form a multipoint contact.

11. The electrical connector according to claim 7, wherein the open slot is formed in a front-to-rear direction with a length greater than that of the contact portion.

12. The electrical connector according to claim 1, wherein the grounding sheet extends backwards from a front end of the tongue to a rear end of the base, and the open slot is formed in a front-to-rear direction.

13. The electrical connector according to claim 12, wherein the open slot extends by a length substantially equal to the length of the grounding sheet.

14. The electrical connector according to claim 1, further comprising a metal housing sleeved over the body, wherein the at least one grounding pin is in contact with the metal housing.

15. The electrical connector according to claim 14, wherein the metal housing comprises at least one soldering leg configured to be soldered to a circuit board.

16. The electrical connector according to claim 1, wherein the at least one grounding pin is configured to be directly soldered to a circuit board.

* * * * *